US009841708B2

(12) United States Patent
Ishida

(10) Patent No.: US 9,841,708 B2
(45) Date of Patent: Dec. 12, 2017

(54) IMAGE FORMING APPARATUS HAVING POWER SUPPLY THAT APPLIES REVERSE-BIAS VOLTAGE TO TRANSFER MEMBER

(71) Applicant: Konica Minolta, Inc., Chiyoda-ku, Tokyo (JP)

(72) Inventor: Hirofumi Ishida, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/078,809

(22) Filed: Mar. 23, 2016

(65) Prior Publication Data

US 2016/0282773 A1 Sep. 29, 2016

(30) Foreign Application Priority Data

Mar. 26, 2015 (JP) ..... 2015-064094

(51) Int. Cl.
*G03G 15/16* (2006.01)
*G03G 15/00* (2006.01)

(52) U.S. Cl.
CPC ..... *G03G 15/1675* (2013.01); *G03G 15/1605* (2013.01); *G03G 15/5045* (2013.01); *G03G 2215/0132* (2013.01)

(58) Field of Classification Search
CPC ..... G03G 15/1675; G03G 15/1605; G03G 2215/0132; G03G 15/168; G03G 15/5045; G03G 15/5033; G03G 2215/00084
See application file for complete search history.

(56) References Cited

U.S. PATENT DOCUMENTS 6,058,275 A * 5/2000 Kodama ..... G03G 15/065 399/46
2005/0281569 A1* 12/2005 Nishimura ..... G03G 15/1675 399/31
2015/0110510 A1* 4/2015 Ishikawa ..... G03G 15/1605 399/66

FOREIGN PATENT DOCUMENTS

JP 06118813 A * 4/1994
JP 06130837 A * 5/1994
(Continued)

OTHER PUBLICATIONS

Notice of Reasons for Refusal dated Feb. 21, 2017, issued by the Japanese Patent Office in corresponding Japanese Patent Application No. 2015-064094, and English translation (7 pages).
(Continued)

*Primary Examiner* — David M Gray
*Assistant Examiner* — Laura Roth
(74) *Attorney, Agent, or Firm* — Buchanan Ingersoll & Rooney PC

(57) ABSTRACT

An image forming apparatus has an image carrier carrying a toner image; a transfer member made with an ion conductive material and forming a transfer nip by being pressed by the image carrier; and a power supply continuously applying a transfer bias voltage to the transfer member as a plurality of print media pass through the transfer nip. The transfer bias voltage has a predetermined polarity. A control section determines whether the resistance of a nip-margin area has exceeded a predetermined resistance threshold, the nip-margin area being a marginal portion of the transfer nip through which no print medium passes. When the determination of the control section is affirmative, the power supply applies a reverse-bias voltage to the transfer member, the reverse-bias voltage having an opposite polarity to the transfer bias voltage.

14 Claims, 14 Drawing Sheets

(56) References Cited

FOREIGN PATENT DOCUMENTS

| | | | |
|---|---|---|---|
| JP | H08-123222 | A | 5/1996 |
| JP | H09-114273 | A | 5/1997 |
| JP | 2006-163266 | A | 6/2006 |
| JP | 2009-192643 | | 8/2009 |

OTHER PUBLICATIONS

Decision on Refusal issued in corresponding Japanese Patent Application No. 2015-064094, dated Jul. 4, 2017, with English Translation (6 pages).

* cited by examiner

| | INITIAL STAGE | AFTER CONTINUOUS PRINTING |
|---|---|---|
| R1 | 1E+7 | 5E+7 |
| Rm | 1E+9 | 1E+9 |
| R2 | 1E+7 | 1E+8 |
| I1 | ABOUT6μA | ABOUT50μA |
| I2 | ABOUT594μA | ABOUT550μA |

IMAGE FORMING APPARATUS HAVING POWER SUPPLY THAT APPLIES REVERSE-BIAS VOLTAGE TO TRANSFER MEMBER

This application is based on Japanese Patent Application No. 2015-064094 filed on Mar. 26, 2015, the content of which is incorporated herein by reference.

BACKGROUND OF THE INVENTION

1. Field of the Invention

The present invention relates to image forming apparatuses using electrophotographic technology, more particularly to an image forming apparatus including a transfer member made with an ion conductive material.

2. Description of Related Art

The electrographic technology renders it possible to readily obtain a high-quality image and therefore is widely used in image forming apparatuses such as printers. As is well-known, the electrographic technology incorporates a charging step, an exposing step, a developing step, a transferring step, a cleaning step, and a fixing step. Among these steps, in the transferring step, a toner image formed on a photoreceptor drum is transferred either using an intermediate transfer belt or directly onto a print medium, such as a sheet of paper or an overhead projector (OHP) sheet. In the transferring step, a transfer roller is pressed against an image carrier, such as the photoreceptor drum or the intermediate transfer belt, forming a transfer nip therebetween. When the print medium passes through the transfer nip, a transfer bias voltage is applied to the transfer roller, so that a charge having an opposite polarity to toner is provided to the back face of the print medium. Thus, the toner image is transferred from the image carrier onto the print medium.

Some transfer rollers have a layer made of an ion conductive material (e.g., a rubber layer). Such a transfer roller passes current by means of ions in the layer carrying electrons. However, during a print operation, if a transfer bias voltage of the same polarity continues to be applied to the transfer roller, the ions are unevenly distributed in the transfer roller. As a result, the ions that carry electrons decrease in number compared to the initial state, so that the resistance of the transfer roller rises. The degree of the uneven ion distribution increases as the amount of current running through the transfer roller, which is determined by the value of current and the time of application, increases. In other words, the resistance of the transfer roller increases proportionally to the increase of the amount of current.

In view of the above, for example, in Japanese Laid-Open Patent Publication No. 2006-163266, once the resistance of the transfer roller has exceeded a threshold, a reverse-bias voltage V2, which has an opposite polarity to the transfer bias voltage used in the transferring step, is applied to the transfer roller. Consequently, the uneven ion distribution in the transfer roller is lessened, resulting in lower resistance of the transfer roller.

Incidentally, the transfer nip includes an area through which the print medium passes (i.e., a passage area) and an area through which no medium passes (i.e., a nip-margin area). Here, the nip-margin area of the transfer roller is not affected by the resistance of the print medium, and therefore, at the initial stage of continuous printing (i.e., serial printing on a plurality of print media), the nip-margin area passes a higher current compared to the passage area. However, the resistance of the ion conductive material rises as the value of current increases, and therefore, the resistance of the nip-margin area rises faster than the resistance of the passage area. In other words, the amount of current in the nip-margin area gradually decreases. As a result, at some point during the continuous printing, the amount of current in the passage area might become excessively high, resulting in a so-called excessive transfer. Here, the excessive transfer refers to a phenomenon where the toner on the image carrier is inversely charged because the current running through the passage area is excessively high relative to the amount of charge in the toner, so that the toner is not properly transferred to the print medium. Such an excessive transfer might lead to print density failure.

However, in Japanese Laid-Open Patent Publication No. 2006-163266, the reverse-bias voltage V2 is applied to the transfer roller depending on the resistance of the entire transfer roller, including a portion on which the print medium is present. In other words, an increase in the current value of the passage area due to an increase in the resistance of the nip-margin area is not taken into consideration. Accordingly, there is a problem where the reverse-bias voltage V2 is not applied at an appropriate time, leading to susceptibility to print density failure.

SUMMARY OF THE INVENTION

An image forming apparatus according to an embodiment of the present invention includes: an image carrier being rotatable while carrying a toner image; a transfer member being rotatable while forming a transfer nip by being pressed by the image carrier, the image carrier being made with an ion conductive material; a power supply continuously applying a transfer bias voltage to the transfer member as a plurality of print media pass through the transfer nip, the transfer bias voltage having a predetermined polarity; and a control section determining whether the resistance of a nip-margin area has exceeded a predetermined resistance threshold, the nip-margin area being a marginal portion of the transfer nip through which no print medium passes, wherein, when the determination of the control section is affirmative, the power supply applies a reverse-bias voltage to the transfer member, the reverse-bias voltage having an opposite polarity to the transfer bias voltage.

DETAILED DESCRIPTION OF THE PREFERRED EMBODIMENTS

Hereinafter, embodiments of an image forming apparatus according to the present invention will be described in detail with reference to the drawings.

Section 1: Definitions

Some figures show x-, y-, and z-axes perpendicular to one another. The x- and z-axes respectively represent the right-left direction and the top-bottom direction of an image forming apparatus 1A, 1B, or 1C. The y-axis represents the front-back direction of the image forming apparatus 1A, 1B, or 1C. The y-axis also represents the direction in which a secondary transfer roller 4 or a photoreceptor drum 5 extends.

Section 2: First Embodiment (General Configuration and Print Operation of Image Forming Apparatus)

Figure 1:
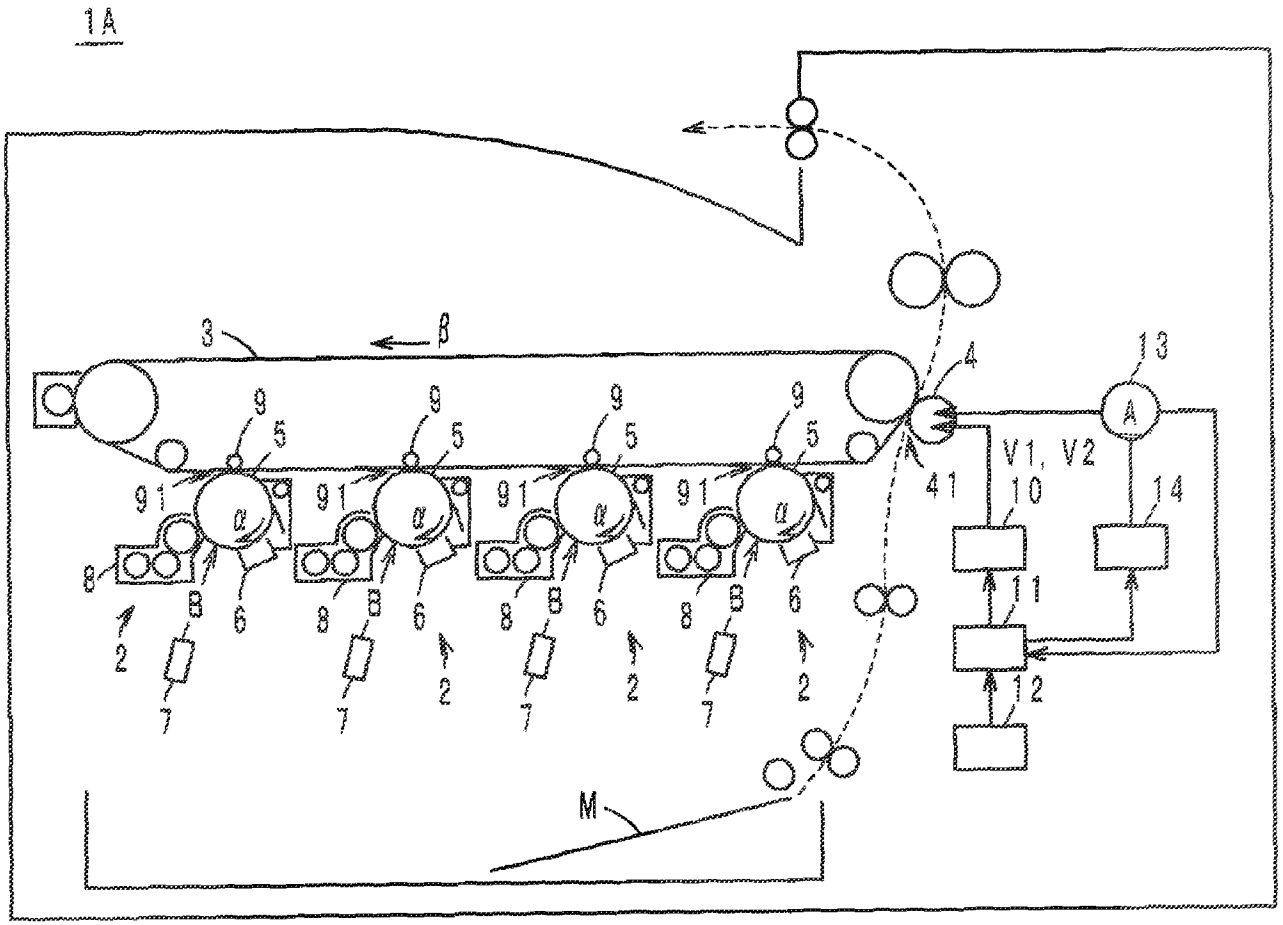
FIG. 1 is a diagram illustrating the configuration of an image forming apparatus according to a first embodiment.

In FIG. 1, the image forming apparatus 1A according to a first embodiment is, for example, a copier, printer, or fax machine, or a multifunction machine provided with all or some of the functions, and is adapted to print a variety of types of images (typically, full-color or monochrome images) on print media M (e.g., paper or OHP sheets) using a tandem system with a well-known electrophotography technology. To this end, the image forming apparatus 1A typically includes imaging units 2 for the colors yellow (Y), magenta (M), cyan (C), and black (K), an intermediate transfer belt 3, and a secondary transfer roller 4.

For example, the imaging units 2 for the four colors are arranged side by side in the x-axis direction and include respective photoreceptor drums 5 for their corresponding colors. Each photoreceptor drum 5 is in the shape of a cylinder extending in the y-axis direction, and rotates about its own axis, for example, in the direction of arrow α. Arranged around the photoreceptor drum 5, from upstream to downstream in the rotational direction α, are, at least, a charger 6, a developing device 8, and a primary transfer roller 9.

The charger 6 uniformly charges the circumferential surface of the photoreceptor drum 5 while the photoreceptor drum 5 is rotating. Provided below the photoreceptor drum 5 is an exposing device 7. The exposing device 7 irradiates an exposure area of the photoreceptor drum 5, which is immediately downstream from the charged area, with an optical beam B based on image data, thereby forming an electrostatic latent image in a corresponding color.

The developing device 8 supplies a developer for the corresponding color to a developing area of the photoreceptor drum 5, which is immediately downstream from the exposure area, thereby forming a toner image in the corresponding color in the developing area.

The intermediate transfer belt 3 is an example of an image carrier. The intermediate transfer belt 3 is stretched between outer circumferential surfaces of at least two rollers arranged, for example, in the x-axis direction and rotates, for example, in the direction of arrow β. The outer circumferential surface of the intermediate transfer belt 3 abuts, for example, the upper end of each photoreceptor drum 5.

The primary transfer roller 9 is positioned opposite to the photoreceptor drum 5 with the intermediate transfer belt 3 positioned therebetween, and presses the inner circumferential surface of the intermediate transfer belt 3 from above, thereby forming a primary transfer nip 91 between the photoreceptor drum 5 and the intermediate transfer belt 3. During a print operation, the primary transfer roller 9 receives a secondary transfer bias voltage V1 to be described later, so that the toner image on the photoreceptor drum 5 is transferred onto the intermediate transfer belt 3 at the primary transfer nip 91 while the intermediate transfer belt 3 is rotating.

The secondary transfer roller 4 is a typical example of a transfer member. The secondary transfer roller 4 has a layer made of an ion conductive material (e.g., a rubber layer), and is rotatable about its own axis. During a print operation, the secondary transfer roller 4 receives a secondary transfer bias voltage V1 having an opposite polarity to a toner image carried on the outer circumferential surface of the intermediate transfer belt 3. The secondary transfer roller 4 is positioned, for example, near the right end of the intermediate transfer belt 3 so as to press the outer circumferential surface of the intermediate transfer belt 3, forming a secondary transfer nip 41 at the contact between the secondary transfer roller 4 and the intermediate transfer belt 3. During the print operation, the secondary transfer nip 41 receives an incoming print medium M.

The secondary transfer roller 4 is receiving the secondary transfer bias voltage V1 while the print medium M is passing through the secondary transfer nip 41, so that the toner image carried on the intermediate transfer belt 3 is transferred onto the print medium M. The print medium M passes through the secondary transfer nip 41 and a fuser of a well-known type, and thereafter is ejected into a tray as a print.

The image forming apparatus 1A is provided with a switchback path for the purpose of allowing double-side printing, although the path is not shown in FIG. 1 for the sake of clarity. A print medium M having been subjected to printing on one side is introduced to the secondary transfer nip 41 after being turned over via the switchback path.

The image forming apparatus 1A further includes a first power supply 10, a control section 11, a temperature and humidity detection section 12, at least one current detection section 13, and a second power supply 14. The first power supply 10, under control of the control section 11, applies the secondary transfer bias voltage V1 to the secondary transfer roller 4. In addition, the first power supply 10 applies a reverse-bias voltage V2 to be described later to the secondary transfer roller 4.

The control section 11 includes, for example, a ROM, a CPU, an SRAM, and an NVRAM. The CPU executes a control program pre-stored in the ROM using the SRAM as a workspace. Typically, the control section 11 controls a print operation as described above upon reception of a print job.

The temperature and humidity detection section 12 detects the temperature and the humidity inside the image forming apparatus 1A.

Figure 2:
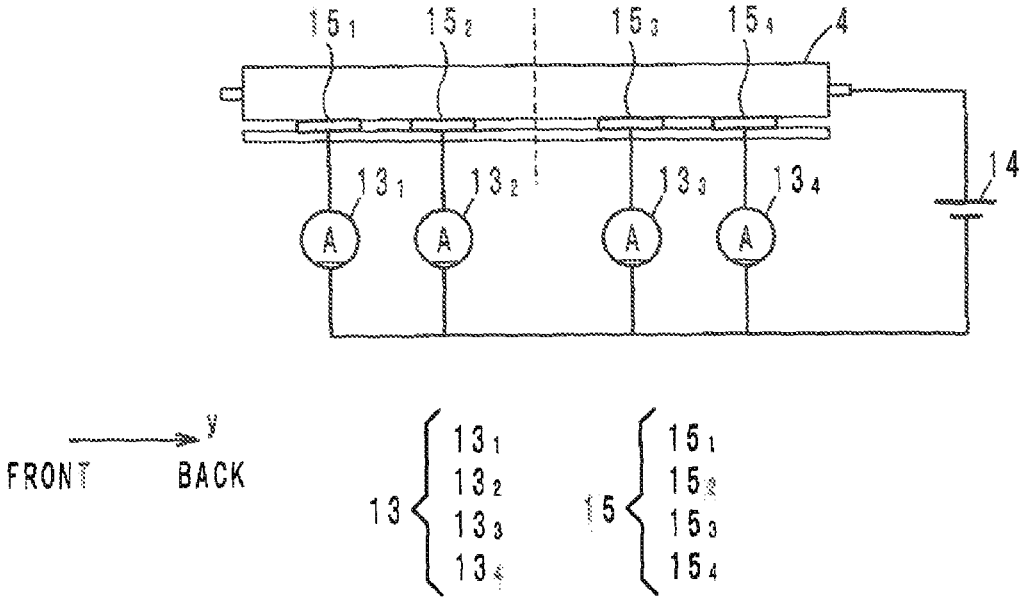
FIG. 2 is a diagram illustrating in detail the configuration of a current detection section shown in FIG. 1.

The at least one current detection section 13 includes four current detection sections $\mathbf{13}_1$, $\mathbf{13}_2$, $\mathbf{13}_3$, and $\mathbf{13}_4$, as illustrated in FIG. 2. The four current detection sections $\mathbf{13}_1$ to $\mathbf{13}_4$ are connected to a plurality of probes 15 (shown as four probes $\mathbf{15}_1$, $\mathbf{15}_2$, $\mathbf{15}_3$, and $\mathbf{15}_4$) capable of coming into and out of contact with the surface of the secondary transfer roller 4. More specifically, the probes $\mathbf{15}_1$ and $\mathbf{15}_4$ are disposed at the front and back ends, respectively, of the secondary transfer roller 4, and the probes $\mathbf{15}_2$ and $\mathbf{15}_3$ are disposed between the probe $\mathbf{15}_1$ or $\mathbf{15}_4$ and the center of the secondary transfer roller 4 in the front-back direction.

Furthermore, the probes $\mathbf{15}_1$ to $\mathbf{15}_4$ are connected to the negative terminal of the second power supply 14 via the current detection sections $\mathbf{13}_1$ to $\mathbf{13}_4$. Note that the positive terminal of the second power supply 14 is connected to the secondary transfer roller 4.

Once the current detection sections $\mathbf{13}_1$ to $\mathbf{13}_4$ as above receive a constant voltage from the second power supply 14, the current detection sections $\mathbf{13}_1$ to $\mathbf{13}_4$ detect values of currents $I_{151}$ to $I_{154}$ running through the probes $\mathbf{15}_1$ to $\mathbf{15}_4$ and output the detected values to the control section 11.

Section 3: Details of Technical Problems

Figure 3:
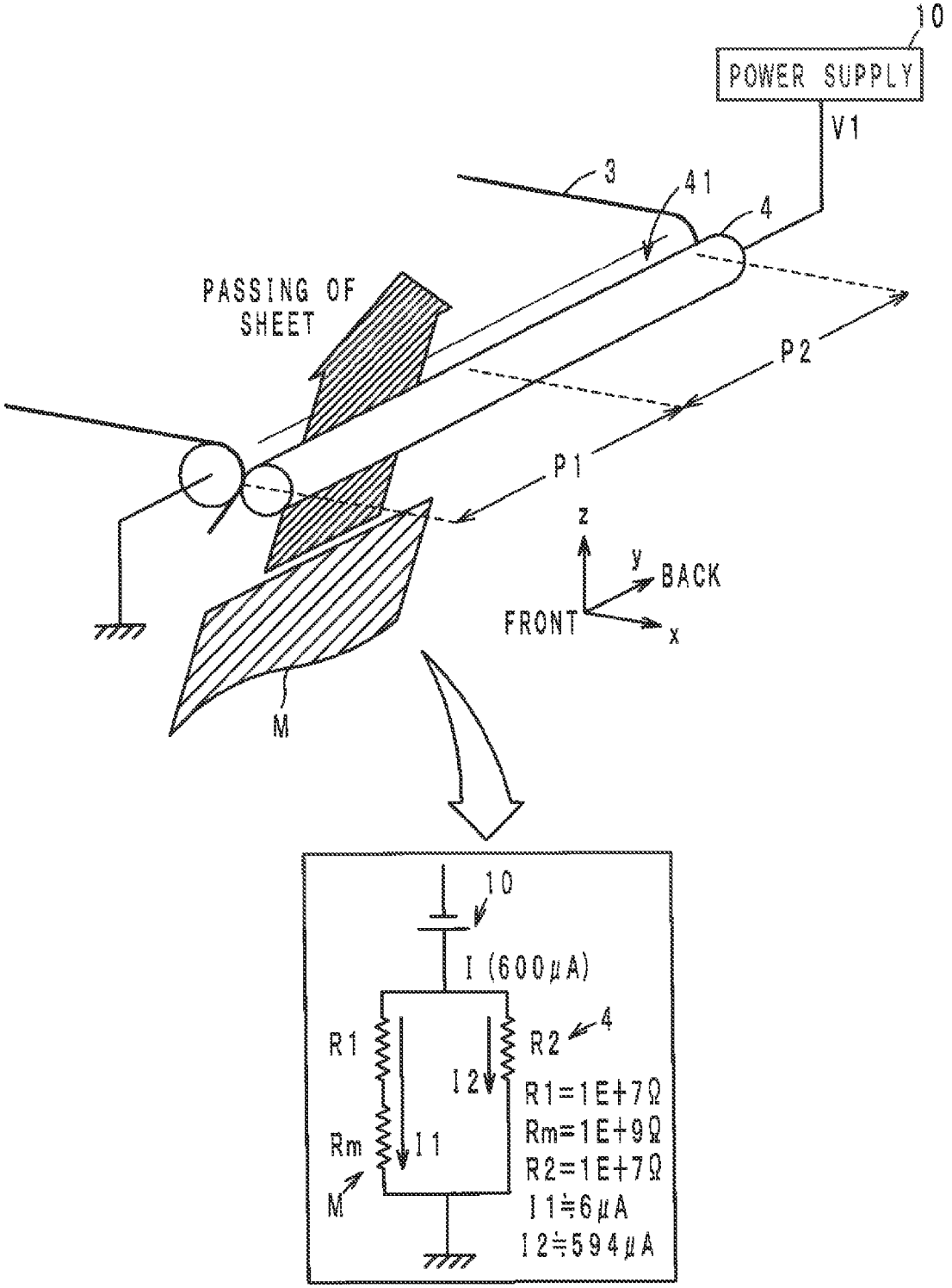
FIG. 3 is a diagram illustrating a passage area and a nip-margin area of a secondary transfer nip shown in FIG. 1.

As shown in the upper portion of FIG. 3, the secondary transfer nip 41 has a passage area P1 and a nip-margin area P2, which are variable in accordance with the size of the print medium M. During application of the secondary transfer bias voltage V1, the print medium M is present in the passage area P1, and therefore, the passage area P1 has a resistance (R1+Rm) higher than the resistance R2 of the nip-margin area P2. Here, R1 is the resistance of the secondary transfer roller 4 in the passage area P1, Rm is the resistance of the print medium M, and R2 is the resistance of the secondary transfer roller 4 in the nip-margin area P2. Accordingly, in the case of continuous printing on print media M of the same size, the amount of current (i.e., current value×application time) in the nip-margin area P2 is normally greater than the amount of current in the passage area P1.

The electrical characteristics of an equivalent circuit between the first power supply 10 and the intermediate transfer belt 3 are represented by an equivalent circuit diagram shown in the lower portion of FIG. 3. It is assumed here that R1 is $1.0\times10^7\Omega$, Rm is $1.0\times10^9\Omega$, and R2 is equal to R1, i.e., $1.0\times10^7\Omega$. Furthermore, during application of the secondary transfer bias voltage V1, the first power supply 10 passes a transfer current I of 600 μA. Under these assumptions, the passage area P1 and the print medium M pass a current I1 of about 6 μA, and the nip-margin area P2 passes a current I2 of about 594 μA. In this manner, there is a significant difference between the currents I1 and I2.

Figure 4:
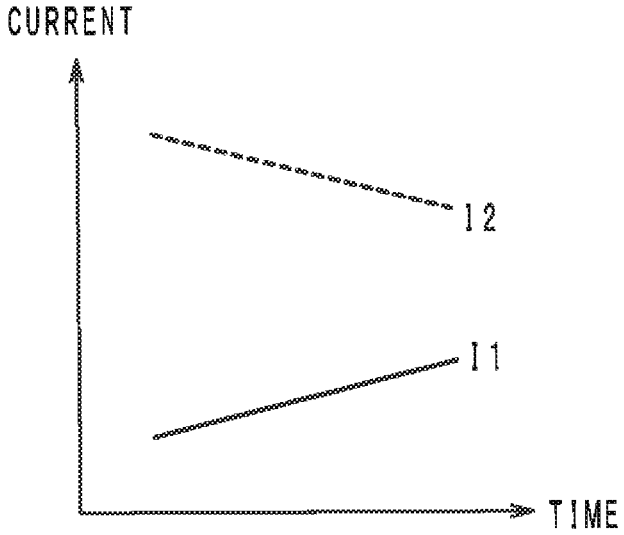
FIG. 4 is a diagram illustrating temporal changes in currents running through the passage area and the nip-margin area in FIG. 3.
Figure 4:
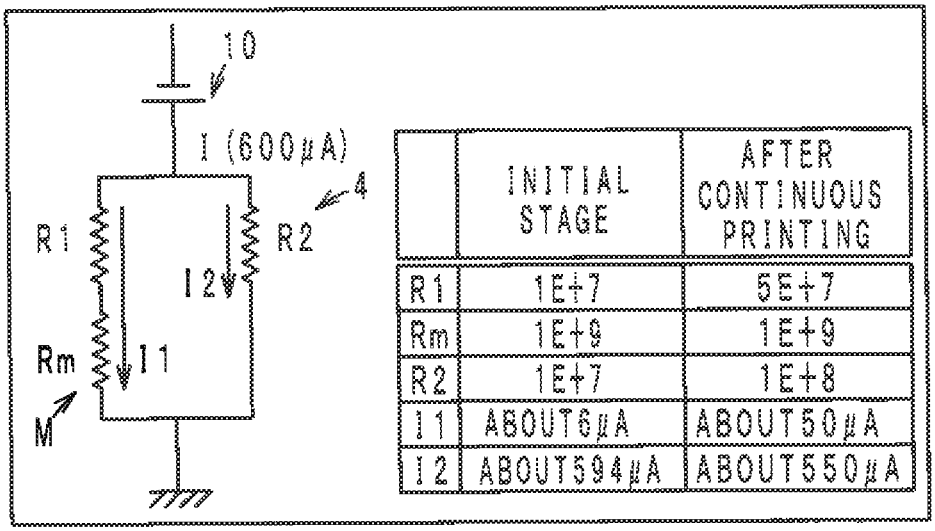

Furthermore, uneven ion distribution in the secondary transfer roller 4 progresses proportionally to the amount of applied current, and therefore, the resistance R2 rises with the amount of applied current more than the resistance R1. Accordingly, during continuous printing, the value of the current I1 increases over time. In contrast, the current value I2 decreases over time (see both the upper and lower portions of FIG. 4). In the course of printing, as the number of passed sheets p of print medium M increases (i.e., as more application time elapses), and the value of the current I1 exceeds a threshold, an excessive transfer might occur, resulting in print density failure. Therefore, in the case where any ion conductive material is used for the secondary transfer roller 4, it is necessary to pay attention to changes in the resistances R1 and R2. Here, when comparing initial values and post-continuous printing values, as shown in the lower portion of FIG. 4, the resistance R1 changes but only slightly, whereas the resistance R2 changes considerably. More specifically, the amount of change in the resistance R2 relative to the number of passed sheets p is significantly greater than the amount of change in the resistance R1. Accordingly, using the change in the resistance R2 renders it easier to determine whether the value of the current I1 has exceeded the threshold.

Note that the amounts of change in the resistances R1 and R2 relative to the number of passed sheets p vary depending not only on the size of the print medium M present in the secondary transfer nip 41 but also on the thickness (or grammage) of the medium, as well as depending on other factors, such as the temperature and the humidity inside the image forming apparatus 1A, whether to perform double-side printing, and the remaining life (i.e., the duration of use) of the secondary transfer roller 4.

Incidentally, in Japanese Laid-Open Patent Publication No. 2006-163266, the resistance of the entire secondary transfer roller (i.e., an average resistance for the nip-margin area and the passage area) is used. More specifically, when the value of the current running upon application of the transfer bias voltage in accordance with the average resistance exceeds a threshold, the reverse-bias voltage is applied to the secondary transfer roller. The average resistance is lower than the actual resistance of the passage area, as shown in the upper panel of FIG. 5. Accordingly, in the case of the approach of Japanese Laid-Open Patent Publication No. 2006-163266, the reverse-bias voltage is not applied at an appropriate time, resulting in a problem of susceptibility to print density failure.

Figure 5:
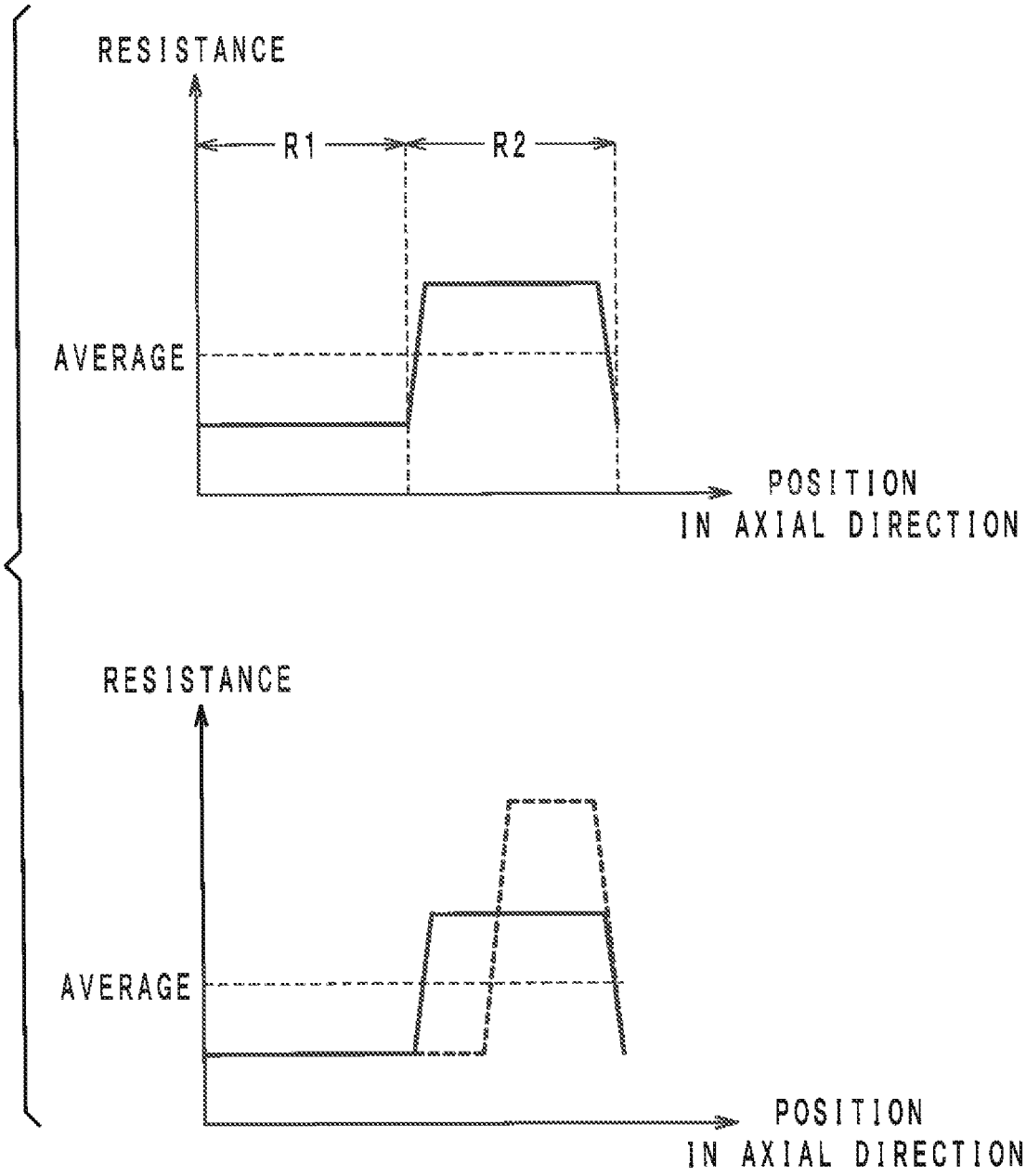
FIG. 5 is a diagram describing a problem with Japanese Laid-Open Patent Publication No. 2006-163266.

Furthermore, even if the size of the print medium varies (i.e., the size of the passage area varies), the resistance of the entire secondary transfer roller might remain the same, as shown in the lower panel of FIG. 5. In such a case also, a situation might occur where the reverse-bias voltage is not applied at an appropriate time. In addition, the rate of the change in resistance of the passage area at the transfer nip varies depending on the content of the print job. Therefore, the approach of Japanese Laid-Open Patent Publication No. 2006-163266 has difficulty in effectively inhibiting print density failure.

Section 4: Essence of Image Forming Apparatus in Relation to Table

Figure 6:
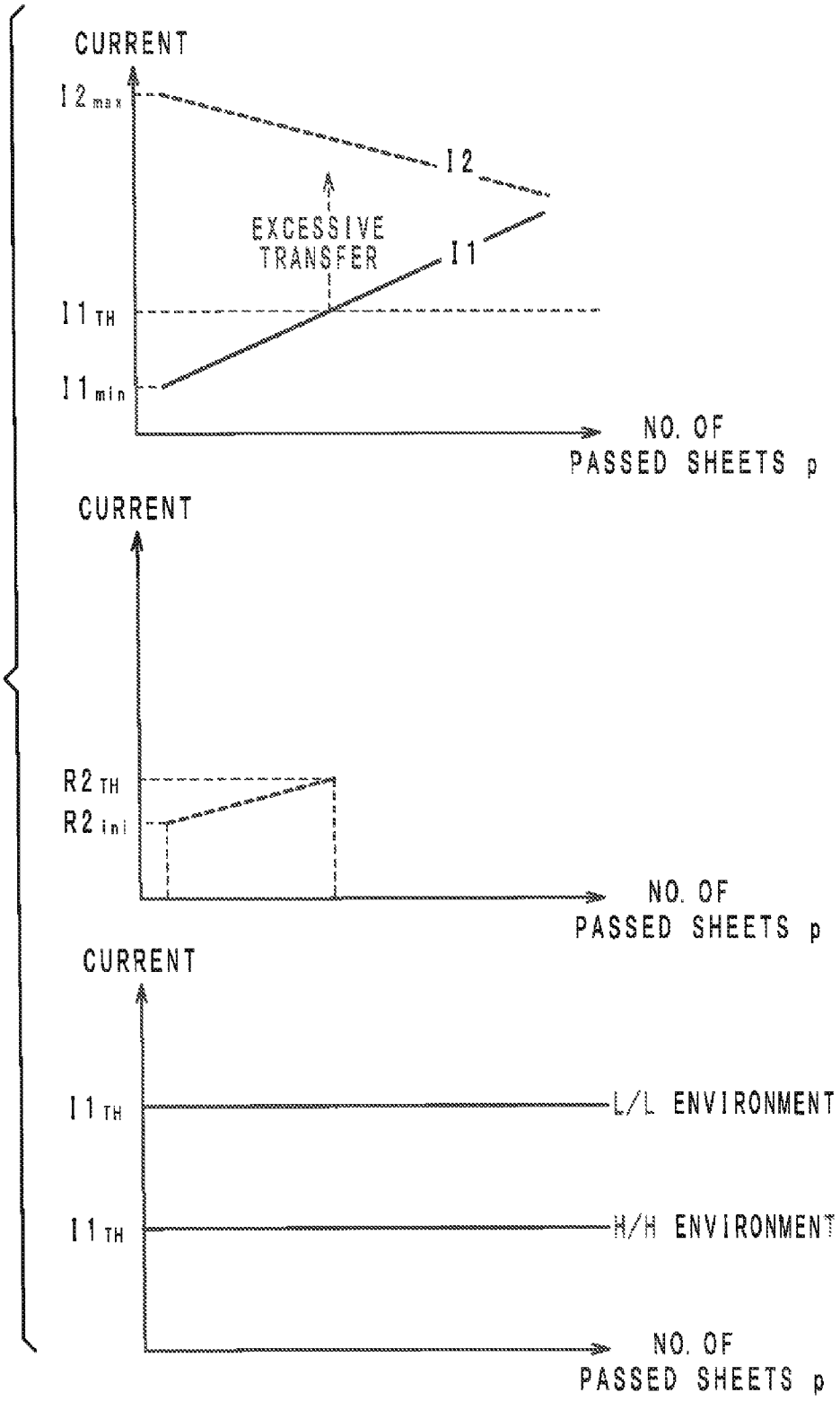
FIG. 6 provides graphs showing current value (upper panel) and resistance (middle panel) of the nip-margin area over the number of passed sheets, along with a graph showing current threshold (lower panel) for each temperature and humidity environment.

In view of the problems described in Section 3, experimentation was carried out at the time of, for example, design of the image forming apparatus 1A in order to obtain linear characteristics of the currents I1 and I2 relative to the number of passed sheets p upon application of a predetermined secondary transfer bias voltage V1 in some representative temperature and humidity environments (see the upper panel of FIG. 6). Here, the number of passed sheets p is in proportion to the duration of current supply to the secondary transfer roller 4 (i.e., the application time of the secondary transfer bias voltage V1). Accordingly, if the secondary transfer bias voltage V1 continues to be applied even after the number of passed sheets p has increased to a certain degree, an excessive transfer will occur eventually. The value of the current I1 at which the excessive transfer starts to occur will be referred to below as a current threshold $I1_{TH}$. Furthermore, the resistance R2 at which the excessive transfer occurs under the aforementioned conditions is derived as a resistance threshold $R2_{TH}$ from the value of the current I2 and the secondary transfer bias voltage V1 where the value of the current I1 is the current threshold $I1_{TH}$ (see the middle panel of FIG. 6). Furthermore, the minimum value of the characteristic line for the value of the current I1 will be referred to as $I1_{min}$. In addition, the maximum value of the characteristic line for the value of the current I2 will be referred to as $I2_{max}$, and the resistance R2 corresponding to this value will be referred to as an initial resistance $R2_{ini}$.

Furthermore, the excessive transfer becomes more likely to occur as the amount of charge in the toner carried on the intermediate transfer belt 3 decreases. Accordingly, if the print job settings and the remaining life of the secondary transfer roller 4 are the same for both a so-called low-temperature and low-humidity environment (L/L environment) and a so-called high-temperature and high-humidity environment (H/H environment), the current threshold $I1_{TH}$ tends to be higher in the L/L environment than in the H/H environment (see the lower panel of FIG. 6), and therefore, the resistance threshold $R2_{TH}$ tends to be higher in the L/L environment as well. Here, the amount of charge in the toner also varies depending on other factors, such as the number of printed pages.

In view of the above, the resistance threshold $R2_{TH}$ for the nip-margin area P2 is obtained in advance for each representative temperature and humidity condition, such as the H/H environment and the L/L environment. Note that the resistance threshold $R2_{TH}$ may also be obtained for any other factor that affects the amount of charge in the toner. For example, the NVRAM of the control section 11 stores a first table $T_1$ listing the resistance threshold $R2_{TH}$ for each temperature and humidity condition, as shown in TABLE 1 below.

TABLE 1

TABLE 1: Contents of Table $T_1$

| Temperature/Humidity Condition | Temperature/Humidity (Representing Value) | Resistance Threshold $R2_{TH}$ |
|---|---|---|
| L/L Environment | 10° C., 15% RH | $R2_{TH1}$ |
| N/N Environment | 25° C., 60% RH | $R2_{TH2}$ |
| H/H Environment | 30° C., 85% RH | $R2_{TH3}$ |

Section 5: Essence of Image Forming Apparatus in Relation to Operation

Next, the operation of the image forming apparatus 1A will be described with reference to FIG. 7. Upon reception of a print job, the control section 11 initially obtains a detection result from the temperature and humidity detection section 12, and retrieves the resistance threshold $R2_{TH}$ that corresponds to the current temperature and humidity condition from the first table T1 (S01). Next, the control section 11 starts executing the print job (S02). During the execution of the print job, the first power supply 10, under control of the control section 11, applies a predetermined secondary transfer bias voltage V1 to the secondary transfer roller 4.

Next, the control section 11 determines whether to end the execution of the print job (S03). If the determination is "Yes", the control section 11 ends the execution of the print job, whereas if the determination is "No", the control section 11 confirms whether the platen gap remains the same as the print medium M has passed through the secondary transfer nip 41 (S04), and causes the probe 154 for an end portion (e.g., for the back-end portion) of the secondary transfer roller 4 to abut on the secondary transfer roller 4 (S05). Thereafter, the second power supply 14, under control of the control section 11, applies a constant voltage to the secondary transfer roller 4 (S06), and the control section 11 acquires the value of a current $I_{154}$ from the current detection section $13_4$ corresponding to the probe $15_4$ (S07). Next, the control section 11 divides the value of the constant voltage applied at S06 by the value of the current $I_{154}$ acquired at S07, thereby deriving the current resistance R2 for the nip-margin area P2 (S08).

Next, the control section 11 determines whether the resistance R2 obtained at S08 has exceeded the resistance threshold $R2_{TH}$ obtained at S01 (S09). If the determination is "No", the control section 11 performs step S03, whereas if the determination is "Yes", the control section 11 stops executing the print job, and thereafter, controls the first power supply 10 to apply a reverse-bias voltage V2, which has an opposite polarity to the polarity of the secondary transfer bias voltage V1, to the secondary transfer roller 4 (S010). Thereafter, the control section 11 determines whether a predetermined waiting period has elapsed (S011). Here, the predetermined period is a period of time until the resistance R2 of the nip-margin area P2 decreases to the initial resistance $R2_{ini}$ (i.e., the period of time in which uneven ion distribution can be lessened), and is determined in advance through experimentation and so on. Note that at S011, whether the resistance R2 has decreased to the initial resistance $R_{min2}$ may be determined by actual measurements using the second power supply 14 and the current detection section 13.

After the determination at S011 results in "Yes", the control section 11 restarts the print job (S012), and performs step S03.

Section 6: Actions and Effects of Image Forming Apparatus

Figure 8:
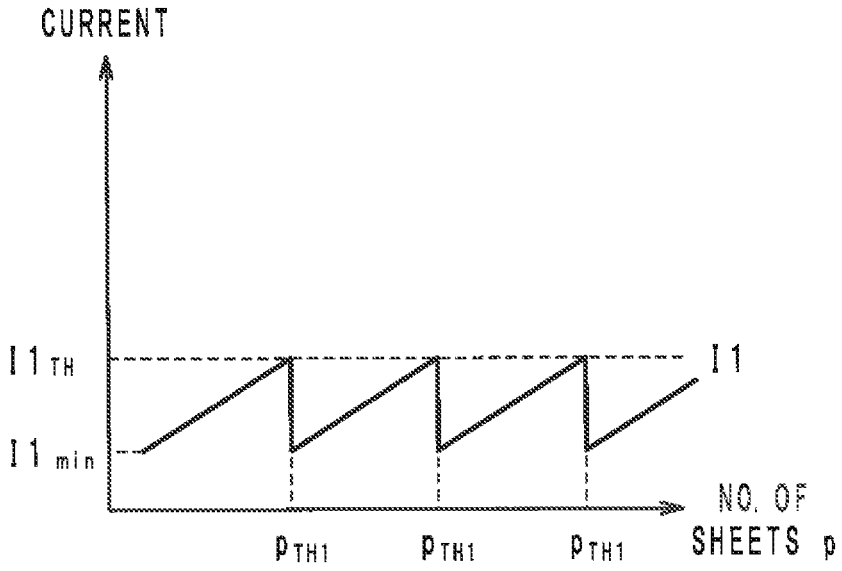
FIG. 8 is a graph showing changes in current running through the passage area in FIG. 3 over the number of passed sheets.

As described earlier, in the image forming apparatus 1A, once the resistance R2 of the nip-margin area P2 exceeds the resistance threshold $R2_{TH}$, the reverse-bias voltage V2 is applied to the secondary transfer roller 4. After that, the secondary transfer bias voltage V1 is applied again. Consequently, temporal changes in the value of the current I1 running through the passage area P1 take the shape of a sawtooth waveform, as shown in FIG. 8, such that the current value falls from the current threshold $I1_{TH}$ to the minimum $I1_{min}$, and thereafter, rises again to the current threshold $I1_{TH}$ by means of the application of the secondary transfer bias voltage V1, and the same pattern is repeated in an approximately cyclic manner. Here, unlike in conventional practice, the timing of applying the reverse-bias voltage V2 is determined on the basis of the resistance R2 of the nip-margin area P2, as described earlier, and therefore, when compared to conventional practice, it is possible to more accurately estimate the timing of a reverse transfer and thereby reduce the occurrence of a reverse transfer. In this manner, the present embodiment renders it possible to provide the image forming apparatus 1A resistant to print density failure.

Section 7: Second Embodiment

Figure 7:
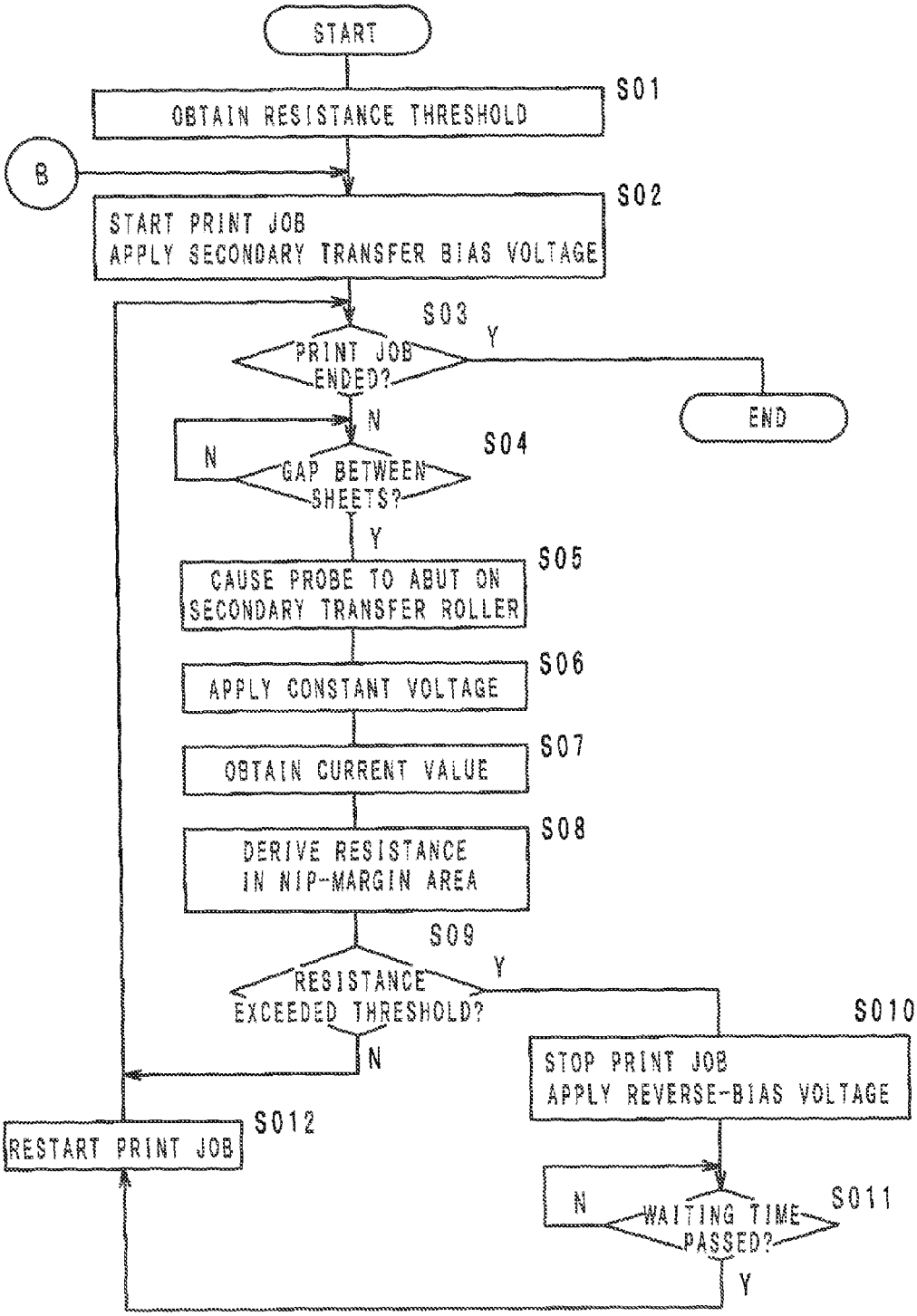
FIG. 7 is a flowchart illustrating the operation of a control section shown in FIG. 1.
Figure 9:
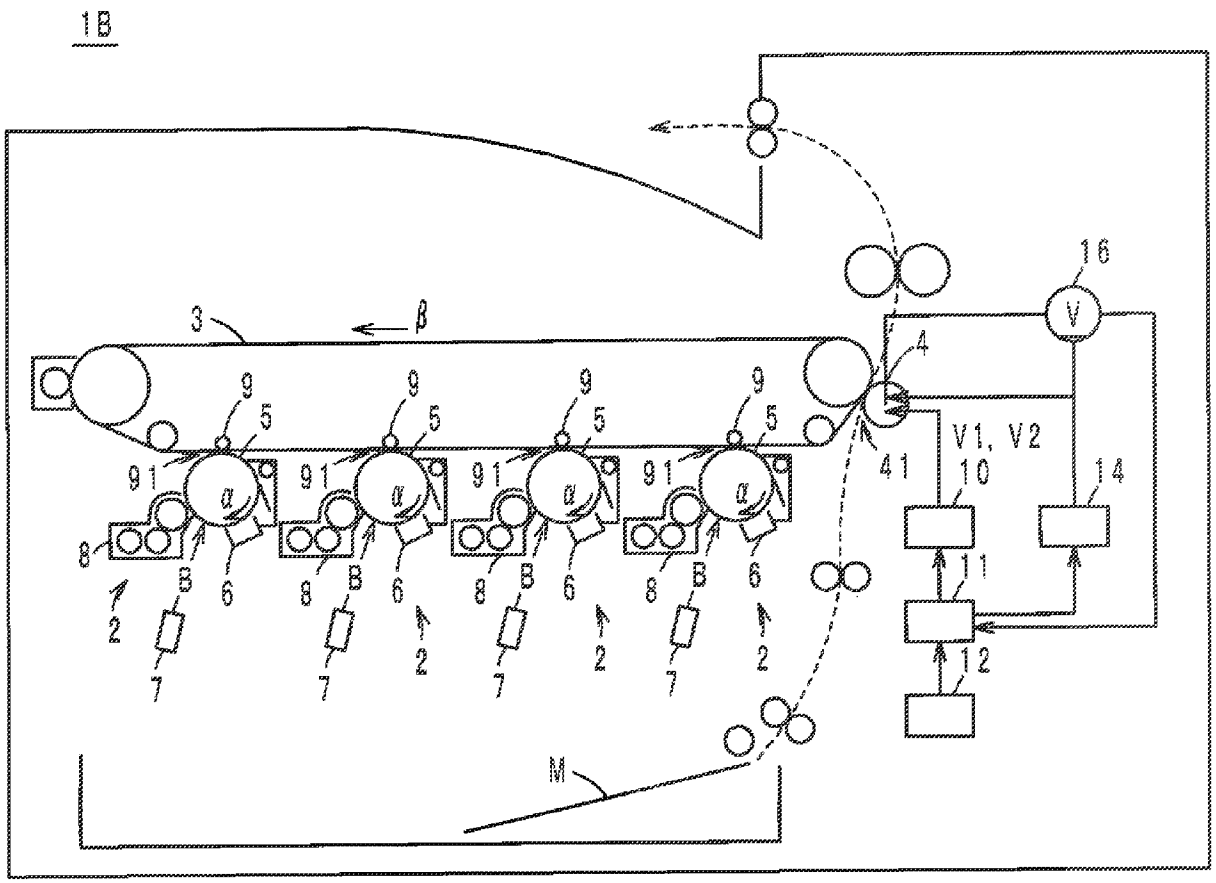
FIG. 9 is a diagram illustrating the configuration of an image forming apparatus according to a second embodiment.
Figure 9:
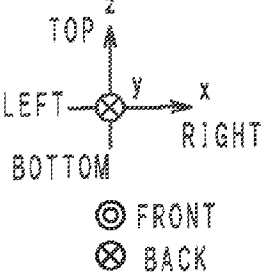

In the first embodiment, the second power supply 14 has been described as supplying a constant voltage at S06 in FIG. 7, but this is not limiting, and as in the case of the image forming apparatus 1B in FIG. 9, the second power supply 14 may provide a constant current, and the control section 11 may derive the current resistance R2 from a voltage value obtained from a voltage detection section 16, and determine the timing of applying the reverse-bias voltage V2.

Section 8: Third Embodiment

In the first and second embodiments, the timing of applying the reverse-bias voltage V2 is decided on the basis of the measured resistance R2. However, the timing of applying the reverse-bias voltage V2 may be decided prior to the execution of a print job, considering the content of the print job, as will be described below.

Figure 10:
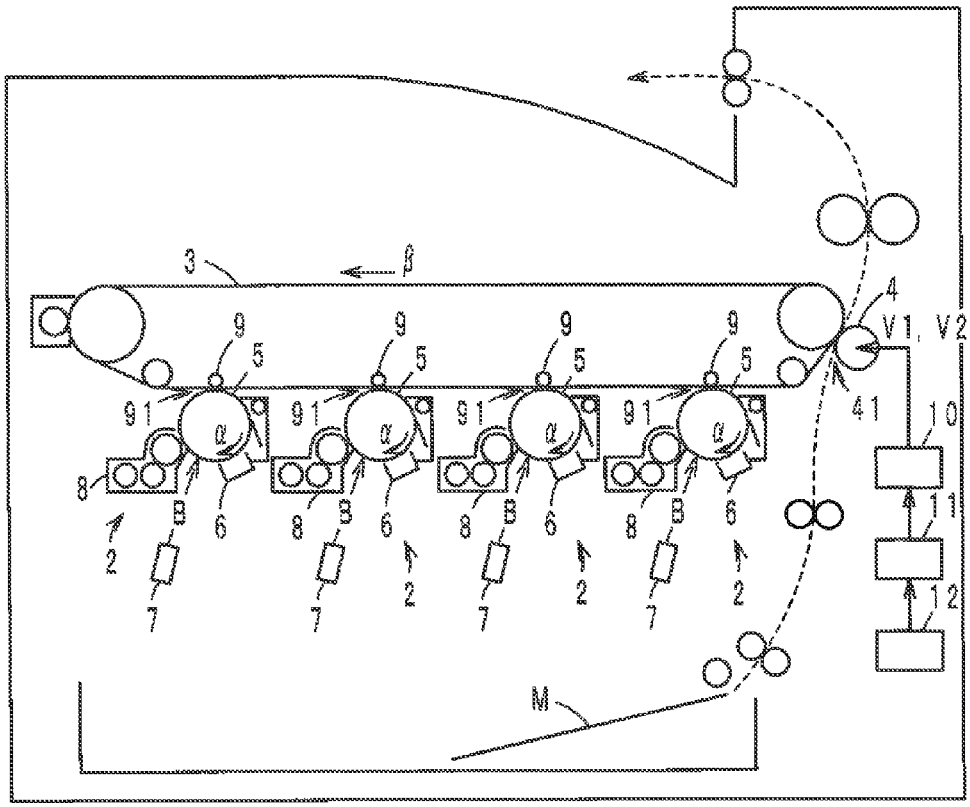
FIG. 10 is a diagram illustrating the configuration of an image forming apparatus according to a third embodiment.
Figure 10:
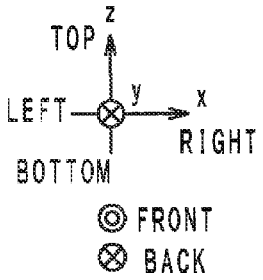

In FIG. 10, the image forming apparatus 1C differs from the image forming apparatus 1A in that the current detection section 13, the second power supply 14, and the probes 15 are not included. The image forming apparatus 1C has no other configurational difference from the image forming apparatus 1A. Accordingly, in FIG. 10, components corresponding to those shown in FIG. 1 are denoted by the same reference characters, and any descriptions thereof will be omitted herein.

Section 9: Essence of Image Forming Apparatus in Relation to Table

In the present embodiment also, the NVRAM or suchlike stores a first table $T_1$ as described in Section 4 (see TABLE 1).

Figure 11:
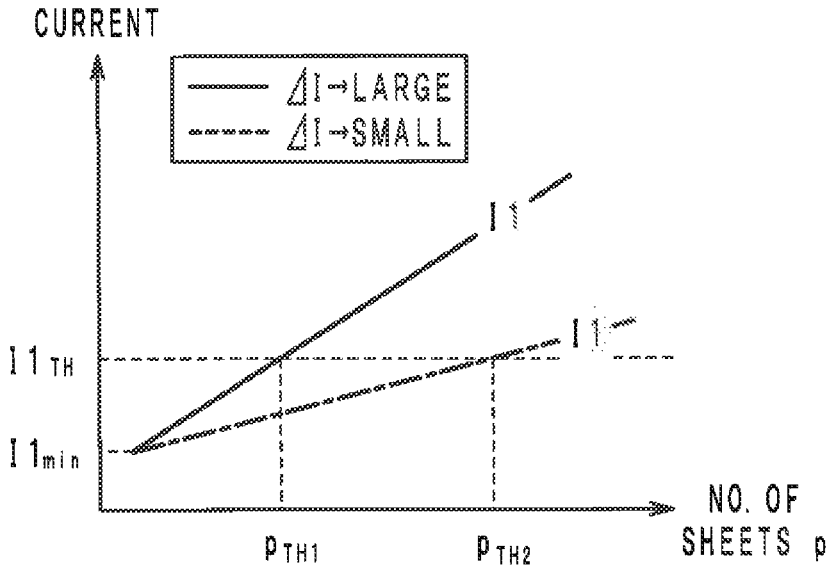
FIG. 11 is a graph showing changes in current value of the passage area and the nip-margin area in accordance with the size of a print medium and other factors.

Furthermore, the amount of change in the resistance R2 relative to the number of passed sheets p (referred to below as the first resistance change rate ΔR2) varies depending on the content of the print job and the remaining life of the secondary transfer roller 4. For example, the value of the current I1 changes more significantly relative to the number of passed sheets p as the size or thickness (or grammage) of the print medium M increases or as the design life of the secondary transfer roller 4 becomes closer to the end (see FIG. 11). The same can be said of the value of the current I2. Correspondingly, the resistance R2 changes significantly, so that the first resistance change rate ΔR2 increases. Moreover, the water content of the print medium M decreases during double-side printing, so that the resistance Rm of the print medium M rises. Accordingly, at the time of double-side printing, the value of the current I1 changes significantly (see FIG. 11) compared to the time of single-side printing, and therefore, the value of the current I2 and also the resistance R2 changes significantly, so that the first resistance change rate ΔR2 increases.

In view of the above, the characteristics of the resistance R2 relative to the number of passed sheets p are obtained in advance in relation to the size and the thickness of the print medium M, the remaining life of the secondary transfer roller 4, and whether to perform double-side printing, as well as for each combination thereof, and on the basis of the obtained characteristics, first resistance change rates ΔR2 relative to the number of passed sheets p are derived. For example, the NVRAM of the control section 11 stores a second table $T_2$ listing the first resistance change rate ΔR2 for each combination of factors, such as the content of the print job and the remaining life of the secondary transfer roller 4, as shown in TABLE 2 below.

TABLE 2

TABLE 2: Contents of Table $T_2$

| Print Medium | | Life of | Double-side | Resistance |
|---|---|---|---|---|
| Size | Thickness (mm) | Roller | Printing | Change Rate ΔR2 |
| A4T | 0.09 | Early Stage | No | $\Delta R2_1$ |
| A4T | 0.09 | Early Stage | Yes | $\Delta R2_2$ |
| A4T | 0.09 | Late Stage | No | $\Delta R2_3$ |
| A4T | 0.09 | Late Stage | Yes | $\Delta R2_4$ |
| . | . | . | . | . |
| . | . | . | . | . |
| . | . | . | . | . |
| B4T | 0.15 | Early Stage | Yes | $\Delta R2_i$ |
| . | . | . | | |
| . | . | . | | |
| . | . | . | | |

As will be described in detail later, the resistance R2 at the end of the print job (i.e., the last resistance $R2_{last}$) can be roughly estimated, and in the present embodiment, as in the first embodiment, the resistance R2 simply takes a value within the limited range from the initial resistance $R2_{ini}$ to the resistance threshold $R2_{TH}$. Moreover, when the application of the secondary transfer bias voltage V1 stops upon the end of the print job, uneven ion distribution in the secondary transfer roller 4 is lessened over time, so that the resistance of the secondary transfer roller 4 decreases. Accordingly, the characteristic of the temporal change in the resistance R2 after the end of the application of the secondary transfer bias voltage V1 is obtained, for example, through experimentation, and a linear approximation thereof is estimated. In this manner, a second resistance change rate Δr2 over time for the resistance R2 after the end of the application of the secondary transfer bias voltage V1 is obtained from the characteristic. In the third embodiment, for example, the NVRAM stores a third table $T_3$ listing the initial resistance $R2_{ini}$ and the second resistance change rate Δr2 for each temperature and humidity condition, as shown in TABLE 3 below.

TABLE 3

TABLE 3: Contents of Table $T_3$

| Temperature/Humidity Condition | Initial Resistance Value $R2_{ini}$ | Resistance Change Rate Δr2 |
|---|---|---|
| L/L Environment | $R2_{ini1}$ | $\Delta r2_1$ |
| N/N Environment | $R2_{ini2}$ | $\Delta r2_2$ |
| H/H Environment | $R2_{ini3}$ | $\Delta r2_3$ |

Section 10: Essence of Image Forming Apparatus in Relation to Operation

Figure 12:
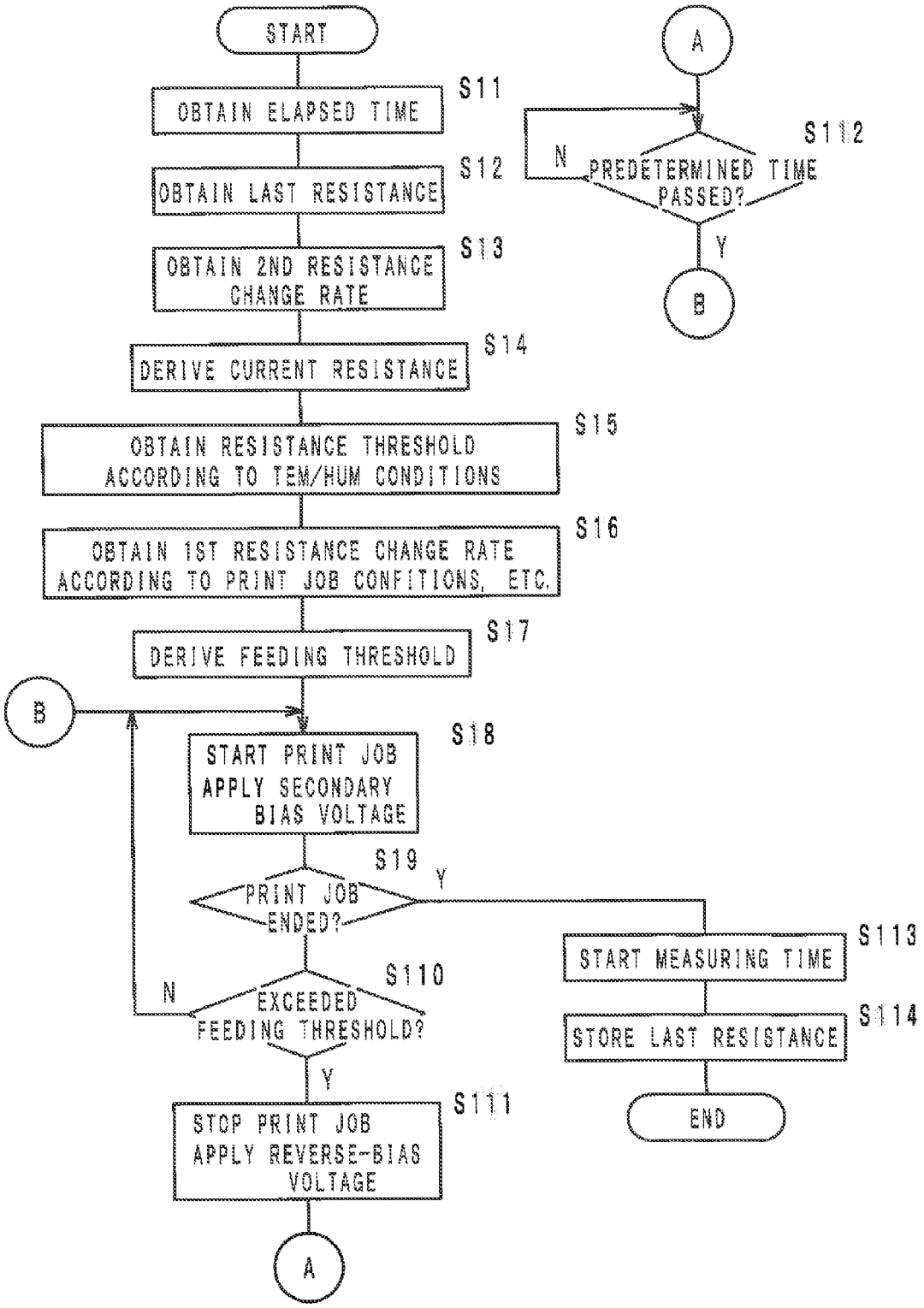
FIG. 12 is a flowchart illustrating the operation of a control section shown in FIG. 10.

Next, the operation of the image forming apparatus 1C will be described with reference to FIG. 12. In the image forming apparatus 1C, upon reception of a new print job, the control section 11 obtains an elapsed time $t_1$ since the end of the previous application of the secondary transfer bias voltage V1, on the basis of, for example, the count of an internal timer, which has been activated in a manner as will be described later in conjunction with S113 (S11).

The control section 11 further obtains the last resistance $R2_{last}$, which has been stored in a manner as will be described later in conjunction with S114 (S12). Here, the last resistance $R2_{last}$ is approximately equal to the resistance R2 at the end of the previous application of the secondary transfer bias voltage V1. Next, the control section 11 receives a detection result from the temperature and humidity detection section 12, and retrieves the second resistance change rate Δr2 that corresponds to the current temperature and humidity environment, from the third table $T_3$ (S13).

Thereafter, the control section 11 derives the current resistance R2 of the nip-margin area P2 from the elapsed time $t_1$, the last resistance $R2_{last}$, and the second resistance change rate Δr2 (S14). The current resistance R2 is calculated by $\Delta r2 \cdot t_1 + R2_{last}$. Note that the resistance R2 has to be greater than or equal to 0, and therefore, if the calculation result is negative, the resistance R2 is considered as 0.

Next, the control section 11 retrieves the resistance threshold $R2_{TH}$ that corresponds to the temperature and humidity environment at S13, from the first table $T_1$ (S15). Next, the control section 11 retrieves from the second table $T_2$ the first resistance change rate ΔR2 that matches information included in the print job (more specifically, the size and the thickness of the print medium M to be used for the current job and whether to perform double-side printing) and the remaining life of the secondary transfer roller 4 (S16).

Next, the control section 11 derives a feeding threshold $p_{TH}$ which is the number of sheets to be passed until the resistance increases from the initial value $R2_{ini}$ stored in the third table $T_3$ to the resistance threshold $R2_{TH}$ obtained at S15, from the first resistance change rate ΔR2 obtained at S16 (S17). Specifically, the feeding threshold $p_{TH}$ is calculated by $(R2_{TH}-R2_{ini})/\Delta R2$. Note that it is expected that the value of the elapsed time $t_1$ is low and hence uneven ion distribution is lessened unsatisfactorily, and therefore, an initial value $p_{TH0}$) for the feeding threshold $p_{TH}$ may be obtained beforehand with reference to the current resistance R2 obtained at S14.

Next, as at S02 and S03 described earlier, the control section 11 starts executing the print job (S18), and thereafter determines whether to end the execution of the print job (S19). If the determination at S19 is "No", the control section 11 determines whether the number of sheets passed through the secondary transfer nip 41 has exceeded the feeding threshold $p_{TH}$ (S110). Note that only immediately after the start of the execution of the print job, it is preferable that the control section 11 uses the initial value $p_{TH0}$ in place of the feeding threshold $p_{TH}$.

If the determination at S110 is "No", the control procedure of the control section 11 returns to S18. On the other hand, if the determination is "Yes", the control section 11 considers the resistance R2 to have exceeded the resistance threshold $R2_{TH}$ and then stops the execution of the print job before controlling the first power supply 10 to apply the reverse-bias voltage V2 (see the first embodiment for details) to the secondary transfer roller 4 (S111). Thereafter, as at S11 described earlier, the control section 11 waits for a predetermined period of time (S112), and executes the processing of S18 again.

In the case where the determination at S19 is "Yes", the control section 11 terminates the printing process. In the course of the termination, the control section 11 resets the internal timer, starts measuring an elapsed time since the end of the application of the secondary transfer bias voltage V1 (S113), and stores the current resistance R2 as the last resistance $R2_{last}$ (S114). Note that the current resistance R2 is a value obtained by dividing the number of printed pages, which is specified by the print job, by the feeding threshold $p_{TH}$ and multiplying the remainder of the division by the first resistance change rate ΔR2.

Section 11: Actions and Effects of Image Forming Apparatus

As described above, in the present embodiment, as in the first embodiment, the value of the current I1 changes over time, as shown in FIG. 8, and therefore, it is rendered possible to provide the image forming apparatus 1C resistant to print density failure.

Section 12: Supplementary

The first resistance change rate ΔR2 can also be determined in accordance with the following factors other than the aforementioned factors:

(1) the fusing temperature at the time of double-side printing; and (2) the temperature and/or the humidity inside the image forming apparatus 1C.

Furthermore, in the above embodiment, the resistance threshold $R2_{TH}$ is determined in accordance with the temperature and humidity environment. However, this is not limiting, and the resistance threshold $R2_{TH}$ may be determined so as to be proportional to the amount of charge in the toner carried on the intermediate transfer belt 3.

Furthermore, in the above embodiment, the first resistance change rate ΔR2 has been described as being obtained based on the second table $T_2$ and other factors. However, this is not limiting, and the control section 11 may have stored therein an arithmetic operation obtained, for example, at the time of design and capable of deriving the first resistance change rate ΔR2 by assigning the size and the thickness of the print medium M, the remaining life of the secondary transfer roller 4, and whether to perform double-side printing. In such a case, upon reception of a print job, the control section 11 obtains the first resistance change rate ΔR2 by assigning necessary variables to the arithmetic operation.

Furthermore, in the above embodiment, the image forming apparatus 1C employs a so-called intermediate transfer system, so that the toner image carried on the intermediate transfer belt 3 is transferred to the print medium M passing through the secondary transfer nip 41. However, this is not limiting, and the present embodiment can also be applied to an image forming apparatus employing a direct transfer system. In such a case, the photoreceptor drum functions as the image carrier, and the transfer roller functions as the transfer member. The same can be said of the image forming apparatuses 1A and 1B.

Section 13: First Modification

Figure 13:
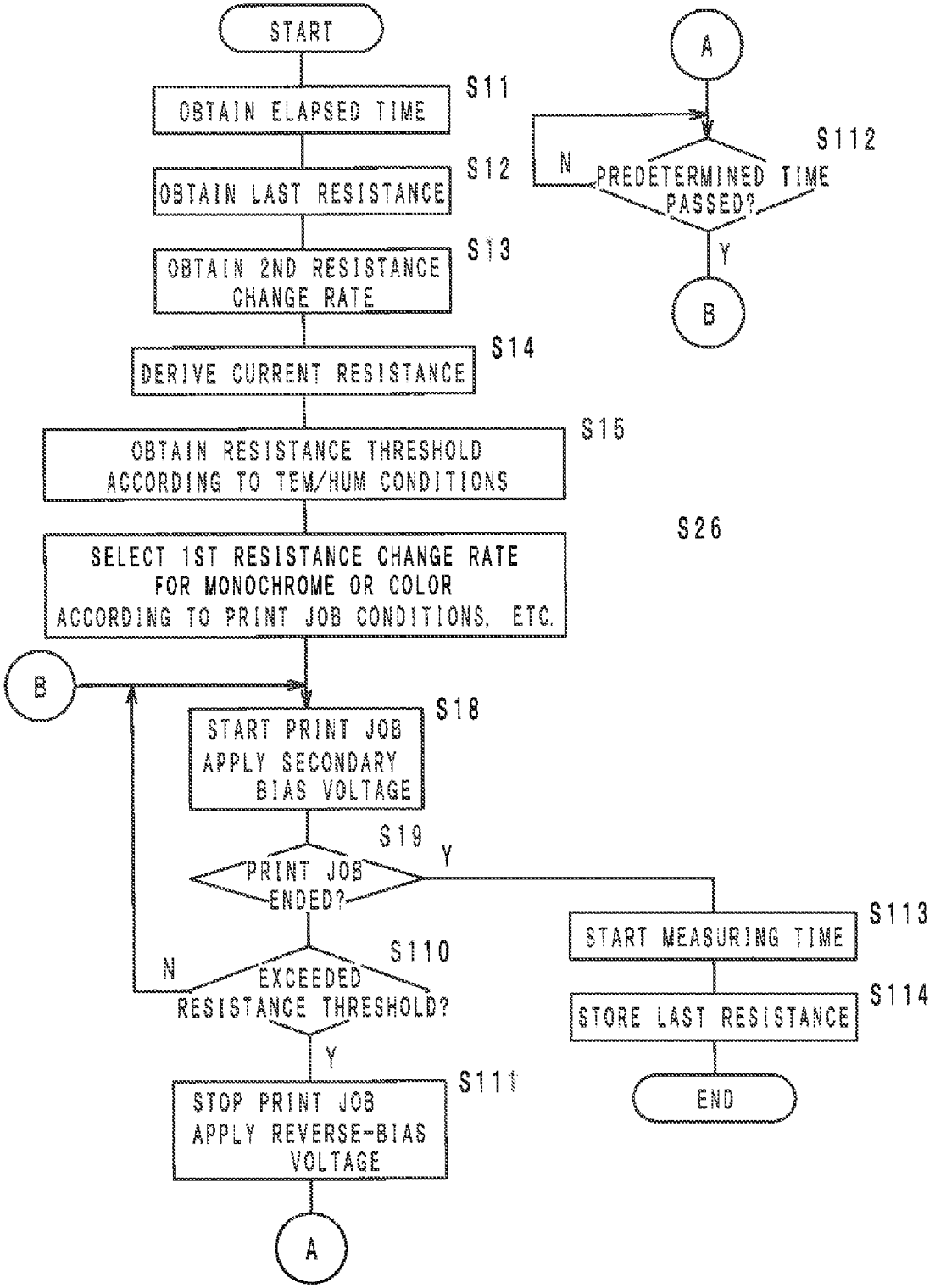
FIG. 13 is a flowchart illustrating the operation of a control section according to a first modification.

In the foregoing description of the third embodiment, printing on all print media M during the execution of a print job is carried out under the same condition. However, in some cases, a single print job might produce monochrome prints and color prints. Such a print job is also called a color/monochrome mixed job. Here, the toner layer is thicker for the color print than for the monochrome print, and therefore, the resistance is higher for the color print than for the monochrome print. In such a case, unlike in the above embodiment, it is preferable that the control section 11 performs the procedure shown in FIG. 13 in place of the procedure shown in FIG. 12. FIG. 13 differs from FIG. 12 in that steps S26 and S210 are included in place of steps S16 and S110, and further, step S17 is omitted. There is no other difference between the procedures shown in both figures, therefore, in FIG. 13, steps corresponding to those in FIG. 12 are denoted by the same reference characters, and any descriptions thereof will be omitted herein.

Initially, at S26 in FIG. 13, on the basis of the condition and other factors for the current print job, the control section 11 selects a first resistance change rate $\Delta R2_c$ for color and a first resistance change rate $\Delta R2_m$ for monochrome from among various first resistance change rates obtained for both color and monochrome, for example, at the time of design.

Furthermore, at S210 in FIG. 13, the control section 11 cumulatively adds the selected first resistance change rate $\Delta R2_c$ to the current resistance R2 of the nip-margin area P2 upon each passing of a color print through the secondary transfer nip 41. On the other hand, the control section 11 cumulatively adds the selected first resistance change rate $\Delta R2_m$ to the current resistance R2 upon each passing of a monochrome print. Thereafter, the control section 11 determines whether the current resistance R2 has exceeded the resistance threshold $R2_{TH}$ obtained at S15.

Figure 14:
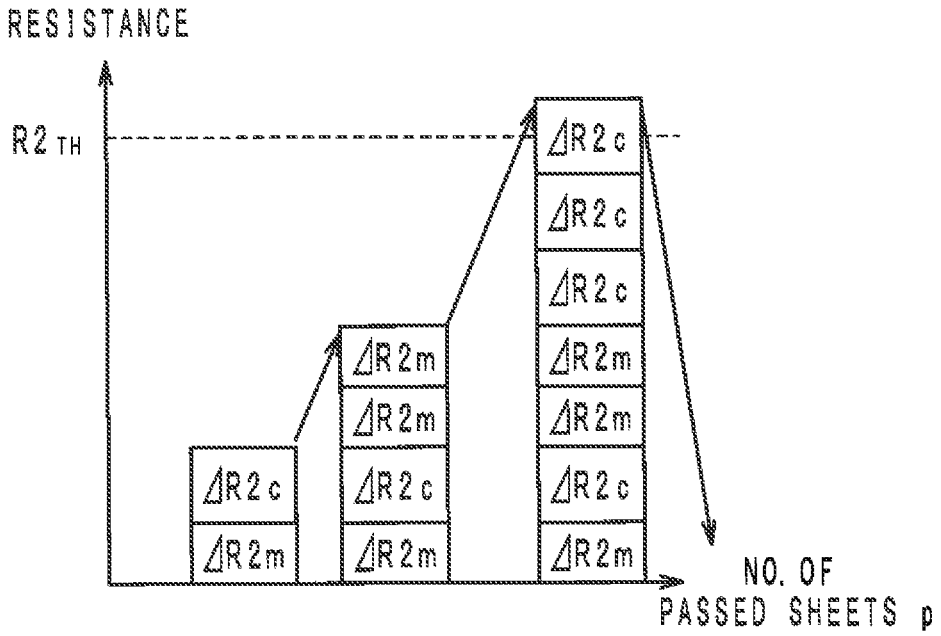
FIG. 14 is a graph showing changes in resistance of the nip-margin area over the number of passed sheets in the first modification.

As a consequence of the procedure in FIG. 13, the control section 11 cumulatively adds an appropriate one of the first resistance change rates $\Delta R2_c$ and $\Delta R2_m$ to the resistance R2 every time the medium M passes through during the execution of the color/monochrome mixed job, as shown in FIG. 14. Once the resistance R2 exceeds the resistance threshold $R2_{TH}$, the reverse-bias voltage V2 is applied to the secondary transfer roller 4. In this manner, in the present modification, the reverse-bias voltage V2 is applied at an appropriate time even during the execution of the color/monochrome mixed job, and therefore, it is rendered possible to provide the image forming apparatus 1C resistant to print density failure.

Section 14: Second Modification

Incidentally, in general, the image forming apparatus 1C performs raster image processing (RIP), so that a variety of types of electronic data sent along with the print job are plotted on raster image data (i.e., bitmap data). In the third embodiment, at S16 in FIG. 12, the first resistance change rate ΔR2 is obtained on the basis of the content of the print job and other factors. However, as is apparent from the foregoing, the thickness of the toner layer on the print medium M affects the change in the resistance R1. Accordingly, at S16 in FIG. 12, the control section 11 may obtain and analyze raster image data through an RIP operation and obtain information about the toner layer thickness and other factors, so that the first resistance change rate ΔR2 is determined considering the obtained information for the toner layer thickness and other factors. Note that in such a case, the table $T_2$ needs to contain first resistance change rates ΔR2 prepared in advance considering the toner layer thickness and other factors.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

an image carrier being rotatable while carrying a toner image;

a transfer member being rotatable while forming a transfer nip by being pressed by the image carrier, the transfer member being made with an ion conductive material;

a power supply continuously applying a transfer bias voltage to the transfer member as a plurality of print media pass through the transfer nip, the transfer bias voltage having a predetermined polarity; and a control section determining whether the resistance of a nip-margin area has exceeded a predetermined resistance threshold, the nip-margin area being a marginal portion of the transfer nip through which no print medium passes, wherein, when the control section determines that the resistance of the nip-margin area has exceeded the predetermined resistance threshold, the power supply applies a reverse-bias voltage to the transfer member, the reverse-bias voltage having an opposite polarity to the transfer bias voltage, and when the control section determines that the resistance of the nip-margin area has not exceeded the predetermined resistance threshold, the power supply does not apply the reverse-bias voltage to the transfer member.

2. The image forming apparatus according to claim 1, further comprising a detection section detecting a value of a current running through the nip-margin area or a value of a voltage being applied to the nip-margin area, wherein, the control section determines the resistance of the nip-margin area on the basis of a current or voltage value at an end portion of the transfer member when a predetermined voltage or current is being supplied.

3. The image forming apparatus according to claim 1, wherein the control section decides the predetermined resistance threshold in accordance with the content of a print job.

4. The image forming apparatus according to claim 1, wherein, the control section decides a first resistance change rate per print medium being passed through the nip-margin area in accordance with the content of a print job, the control section decides a feeding threshold in accordance with the decided first resistance change rate, the feeding threshold being the number of print media to be fed until the resistance of the nip-margin area reaches the predetermined resistance threshold, and once the number of passed print media has exceeded the decided feeding threshold, the control section determines that the resistance of the nip-margin area has exceeded the predetermined resistance threshold.

5. The image forming apparatus according to claim 4, wherein the first resistance change rate is set to a higher value as the print medium increases in size.

6. The image forming apparatus according to claim 4, wherein the first resistance change rate is set to a higher value as the print medium increases in thickness.

7. The image forming apparatus according to claim 4, wherein, in the case of double-side printing, the first resistance change rate is decided in accordance with a fusing temperature.

8. The image forming apparatus according to claim 4, wherein the first resistance change rate is decided in accordance with the duration of use of the transfer member.

9. The image forming apparatus according to claim 4, wherein the first resistance change rate is decided in accordance with a temperature and/or humidity inside the image forming apparatus.

10. The image forming apparatus according to claim 4, wherein, in the case where a single print job includes color printing and monochrome printing, the control section obtains a first resistance change rate for color per print medium being passed through the nip-margin area for color printing and a first resistance change rate for monochrome per print medium being passed through the nip-margin area for monochrome printing, and during execution of the print job, the control section decides the resistance of the nip-margin area while cumulatively adding the first resistance change rate for color upon each color printing task and also cumulatively adding the first resistance change rate for monochrome upon each monochrome printing task.

11. The image forming apparatus according to claim 4, wherein, the control section analyzes electronic data to be printed on each print medium on the basis of the print job, the control section obtains a first resistance change rate per print medium being passed through the nip-margin area on the basis of the analysis result, and the control section decides the resistance of the nip-margin area on the basis of the number of passed print media and the obtained first resistance change rate.

12. The image forming apparatus according to claim 4, wherein, when the control section determines that the resistance of the nip-margin area has exceeded the predetermined resistance threshold, the control section stops a print job and the power supply applies the reverse-bias voltage to the transfer member.

13. The image forming apparatus according to claim 1, further comprising a detection section detecting a temperature and/or humidity inside the image forming apparatus, wherein the control section decides the predetermined resistance threshold in accordance with a temperature and/or humidity inside the image forming apparatus.

14. The image forming apparatus according to claim 1, further comprising a detection section detecting an amount of charge in toner carried on the image carrier, wherein the control section decides the predetermined resistance threshold in accordance with an amount of charge in toner carried on the image carrier.

* * * * *